US005566505A

United States Patent [19]

Kamezaki

[11] Patent Number: 5,566,505

[45] Date of Patent: Oct. 22, 1996

[54] SLIDING DOOR

[76] Inventor: Masaaki Kamezaki, 1305-2, Nakazato, Iwai-shi, Ibaragi-ken, Japan

[21] Appl. No.: 388,404

[22] Filed: Feb. 14, 1995

[30] Foreign Application Priority Data

Feb. 15, 1994 [JP] Japan ..... 6-040429

[51] Int. Cl.[6] ..... E05D 15/10

[52] U.S. Cl. ..... 49/225; 49/209; 49/358

[58] Field of Search ..... 49/208, 209, 221, 49/222, 223, 224, 225, 409, 410

[56] References Cited

U.S. PATENT DOCUMENTS

| | | | |
|---|---|---|---|
| 3,571,976 | 3/1971 | Schmid | 49/130 |
| 3,611,637 | 10/1971 | Saino | 49/410 |
| 4,404,770 | 9/1983 | Markus | 49/409 X |
| 4,433,507 | 2/1984 | Chikaraishi | 49/213 |
| 4,457,108 | 7/1984 | Kuschel et al. | 49/225 X |
| 4,476,652 | 10/1984 | Beauchot | 49/235 |
| 4,619,025 | 10/1986 | Wiles | 49/235 |
| 4,651,469 | 3/1987 | Ngian et al. | 49/223 |
| 5,301,468 | 4/1994 | Kamezaki | 49/225 |

*Primary Examiner*—Jerry Redman
*Attorney, Agent, or Firm*—Fisher & Associates

[57] ABSTRACT

A sliding door capable of permitting both initiation of a door opening operation and termination of a door closing operation to be smoothly and readily accomplished. During the door closing operation, obliquely downward and inward movement of a door body and an action of a link cooperate with each other to permit the door body to be pressedly contacted with an outer wall surface of an object such as a refrigerator using substantially reduced force. During the door opening operation, upward outward movement of the door body and an action of the link permit the door body to be readily released from the outer wall surface using significantly reduced force.

8 Claims, 8 Drawing Sheets

SLIDING DOOR

BACKGROUND OF THE INVENTION

This invention relates to a sliding door such as a single sliding door or a double sliding door, and more particularly to a sliding door for air-tightly selectively closing an entrance of a large-sized freezer, a large-sized refrigerator, a freezing storehouse, a refrigerating storehouse, a clean room or the like which is mainly used for business purpose.

The inventor proposed a sliding door of such a type as disclosed in Japanese Patent Application Laid-Open Publication No. 52072/1993. The sliding door proposed is generally constructed in such a manner as shown in FIGS. 7 and 8.

More particularly, the sliding door proposed includes a door body 101 and bracket assemblies A'. The bracket assemblies A' each including a first bracket a1' which is formed at a lower portion thereof with a first groove and has a rolling wheel 110 rotatably supported in the first groove and a second bracket a2' which is arranged at a predetermined inclination angle and provided at an upper end thereof with an elastic suspension 111. The elastic suspension 111 is arranged in a manner to be slanted at the same angle as the second bracket a2' and includes an extensible rod 111*a*. The first and second brackets a1' and a2' are connected to each other through the extensible rod 111*a* of the elastic suspension 111.

In each of the bracket assemblies A', the second bracket a2' is mounted at a lower portion thereof on an upper portion of the door body 101. The sliding door also includes a rail 112 including an upper rail surface 112*a* and a lower rail surface 112*b* and horizontally rigidly arranged on a wall of an object such as a refrigerator or the like to be operated by the sliding door (hereinafter also merely referred to as "object") above an entrance 104 of the object. The lower rail surface 112*b* of the rail 112 is formed so as to be slanted at the same angle as the inclination angle of the second bracket a2. The rolling wheel 110 is carried on the upper rail surface 112*a* of the rail 112, so that the door body 101 may be suspended by upward elastic force of the elastic suspension 111 while being kept raised from a floor 3 on which the object is installed. The sliding door proposed further includes a third bracket b which is fixed at a lower portion thereof on an upper end of the door body 101 and on which a driving wheel 113 is rotatably supported while being slanted at the same angle as the inclination angle of the bracket a2'. The driving wheel 113 is pressedly abutted against the lower rail surface 112*b* of the rail 112 by upward elastic force of the elastic suspension 111. Such abutment of the driving wheel 113 against the lower rail surface 112*b* permits a degree of raising of a bottom packing of the door body 101 from the floor 103 to be controlled by the elastic suspension 111. The degree of raising of the bottom packing 107 is set to be smaller than a downward slanting section 114.

Also, in the proposed sliding door, the lower rail surface 112*b* of the rail 112 is formed on a portion thereof opposite to the driving wheel 113 of the door body 101 when the door body 101 is moved to an entrance closed position at which the door body 101 closes the entrance 104 of the object with a tapered section 109 on which the driving wheel 113 strikes to extend the extensible rod ilia against upward elastic force of the elastic suspension 111, resulting in the door body 101 being forcibly moved in an obliquely inward and downward direction.

The proposed sliding door constructed as described above actually exhibits significant advantages as compared with a conventional sliding door. More specifically, the conventional sliding door is large-sized and constructed into a heat insulating structure, resulting in being substantially increased in thickness and weight. Also, the conventional sliding door is required to airtightly close the object. For this purpose, a packing arranged around a door body of the door is elastically closely contacted with a wall the object around an entrance of the object and a floor thereof when the object is closed by the door. Unfortunately, this requires highly increased force at both initiation of a door opening operation and termination of a door closing operation. The above-described sliding door proposed by the inventor substantially eliminates such disadvantages encountered with the conventional one.

Nevertheless, the proposed sliding door has a disadvantage of still requiring force of a relatively large level due to frictional resistance between the packing of the door body and an outer wall surface of the object at the time of initiation of a door opening operation and termination of a door closing operation. This results in arrangement of a motor of a relatively increased capacity to be often required. Thus, it would be highly desirable to develop a sliding door which is capable of facilitating the opening and closing operation by hand or by means of a down-sized motor of a reduced capacity.

SUMMARY OF THE INVENTION

The present invention has been made in view of the foregoing disadvantage of the present invention.

Accordingly, it is an object of the present invention to provide a sliding door which is capable of permitting initiation of a door opening operation and termination of a door closing operation to be smoothly and readily accomplished.

In accordance with the present invention, a sliding door is provided. The sliding door includes a door body and a bracket assembly including a first bracket and a second bracket. The first bracket is provided at a lower portion thereof with a first groove which has rolling wheels rotatably supported therein, and includes a mounting seat section which has elastic suspensions mounted on an upper portion thereof while being slanted at a predetermined inclination angle. The elastic suspensions each include an extensible rod. The second bracket is formed at a lower portion thereof with a second groove which has a driving wheel rotatably supported therein while being slanted at the same inclination angle as that of the elastic suspensions and provided at an upper end thereof with a connection section to which the extensible rod of each of the elastic suspensions is connected at a distal end thereof so as to obliquely upwardly force the second bracket by upward elastic force of the elastic suspensions. The second bracket is provided at a lower end thereof with a door mounting section through which the second bracket is mounted on the door body. The sliding door also includes two turning pairs including a first turning pair arranged on an outside of the first groove of the first bracket and a second turning pair arranged on an inside of the second bracket opposite to the outside of the first groove. The first and second turning pairs are connected to each other through a link, resulting in providing the bracket assembly. The door body is mounted at an upper end thereof on the door mounting section of the second bracket, resulting in the bracket assembly being secured to the door body.

Further, the sliding door includes a rail including an upper rail surface on which the rolling wheels of the bracket assembly are carried and a lower rail surface slanted at the same inclination angle as that of the driving wheel and pressedly contacted with the driving wheel so as to downwardly force it. The rail is horizontally rigidly arranged above an entrance of an object to be openably operated by the sliding door. The door body is kept raised from a floor of the object by upward elastic force of the elastic suspensions while carrying the rolling wheels on the upper rail surface of the rail and the driving wheel is kept pressedly contacted with the lower rail surface of the rail by upward elastic force of the elastic suspensions. The lower rail surface of the rail is formed on a portion thereof opposite to the driving wheel when the door body is moved to an entrance closed position at which the door body closes an entrance of the object with a tapered section on which the driving wheel strikes to obliquely move the door body in an inward and downward direction against upward elastic force of the elastic suspension.

In a preferred embodiment of the present invention, the door body is operated by hand or by means of a driving motor arranged on the second bracket for driving the driving wheel.

In a preferred embodiment of the present invention, the elastic suspensions are selected from a group consisting of a spring, a hydraulic cylinder and an air cylinder.

In a preferred embodiment of the present invention, the tapered section may be integrally formed on the lower rail surface. Alternatively, the tapered section may comprise a tapered member arranged on said lower rail surface.

In a preferred embodiment of the present invention, the rail may comprise a single member integrally provided on upper and lower portions thereof with the upper and lower rails surfaces. Alternatively, the rail mat comprise an upper rail section provided thereon with the upper rail surface and a lower rail section provided thereon with the lower rail surface.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1:
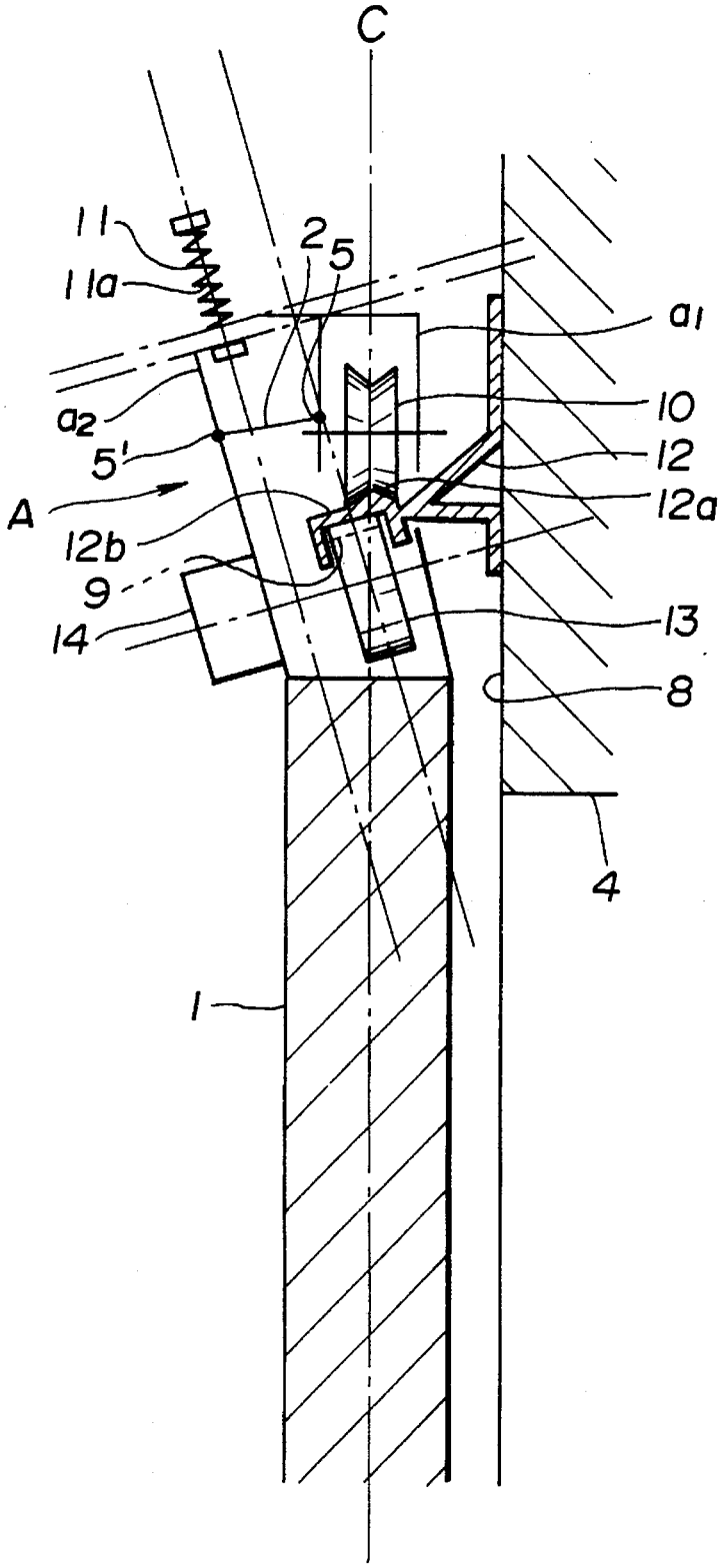
FIG. 1 is a fragmentary schematic sectional view showing an essential part of a sliding door according to the present invention.

Now, a sliding door according to the present invention will be described hereinafter with reference to FIGS. 1 to 6, wherein like reference numerals designate like or corresponding parts throughout.

Referring first to FIGS. 2 to 6, an embodiment of a sliding door according to the present invention is illustrated. A sliding door of the illustrated embodiment generally includes a door body 1 and a bracket assembly A mounted on the door body 1 and including first brackets a1 and second brackets a2.

The first bracket a1 is provided at a lower portion thereof with a first groove 15 which has rolling wheels 10 rotatably supported therein and includes a mounting seat section 16 which has elastic suspensions 11 mounted on an upper portion thereof while being slanted at a predetermined inclination angle. The elastic suspensions 11 each include an extensible rod 11*a*.

The second bracket a2 is formed at a lower portion thereof with a second groove 18 which has a driving wheel 13 rotatably supported therein while being slanted at the same inclination angle as that of the elastic suspensions 11. Also, the second bracket a2 is provided at an upper end thereof with a connection section 17 to which the extensible rod 11*a* of each of the elastic suspensions 11 is connected at a distal end thereof so as to obliquely upwardly force the second bracket a2 by upward elastic force of the elastic suspensions 11.

Further, the second bracket a2 is provided at a lower end thereof with a door mounting section 19 through which the second bracket a2 is mounted on the door body 1.

The extensible rod 11*a* of each of the elastic suspensions 11 mounted on the mounting section 16 of the first bracket a1 at a predetermined inclination angle is thus connected to the connection section 17 of the second bracket a2, so that upward elastic force of each of the elastic suspensions 11 causes the second bracket a2 to be obliquely upwardly forced.

The sliding door of the illustrated embodiment also includes two turning pairs including a first turning pair 5 arranged on an outside of the first groove 15 of the first bracket a1 and a second turning pair 5' arranged on a portion of an inside of the second bracket a2 opposite to the outside of the first groove 15. The first and second turning pairs 5 and 5' are connected to each other through a link 2, resulting in providing the bracket assembly A.

The door body 1 is mounted at an upper end thereof on the door mounting section 19 of the second bracket a2, resulting in the bracket assembly A being secured to the door body 1.

Further, the sliding door includes a rail 12 provided with an upper rail surface 12*a* on which the rolling wheel 10 of the bracket assembly A is carried and a lower rail surface 12*b* slanted at the same inclination angle as that of a wheel shaft of the driving wheel 13 and pressedly contacted with the driving wheel 13 so as to downwardly force it. The rail 12 is horizontally rigidly mounted on an outer wall surface 8 of an object such as a refrigerator or the like to be operated by the sliding door of the illustrated embodiment which is located above an entrance 4 of the object.

The door body 1 is kept raised from a floor 3 of the object by upward elastic force of the elastic suspensions 11 while carrying the rolling wheels 10 on the upper rail surface 12*a* of the rail 12. The driving wheel 13 is kept pressedly contacted with the lower rail surface 12*b* of the rail 12 by upward elastic force of the elastic suspensions 11.

The lower rail surface 12*a* of the rail 12 is formed on a portion thereof rendered opposite to the driving wheel 13 when the door body 1 is moved to an entrance closed position at which the door body 1 closes the entrance 4 of the object with a tapered section 9 on which the driving wheel 13 strikes to obliquely move the door body 1 in an inward and downward direction with respect to the object against upward elastic force of the elastic suspensions 11.

The sliding door of the illustrated embodiment constructed as described above may be of a manual operation type wherein the door body 1 is manually moved or operated. Alternatively, it may be electrically driven by means of an electric motor. In the latter case, the second bracket a2 may be provided thereon with a motor 14 in a manner to be operatively connected to the driving wheel 13 for driving it.

In the illustrated embodiment, the elastic suspensions 11 each comprise a coiled spring wound on the extensible rod 11*a*. Alternatively, it may comprise a hydraulic cylinder or an air cylinder.

Also, in the illustrated embodiment, the tapered section 9 provided on the lower rails surface 12*b* of the rail 12 may comprise a rail-like downwardly slanting member integrally mounted on the lower rail surface 12*b*. Alternatively, it may be constructed in the form of a part of the lower rail surface 12*b* in a manner to obliquely downwardly project therefrom.

Further, in the illustrated embodiment, the rail 12 comprises a single rail member having the upper and lower rail surfaces 12*a* and 12*b* integrally formed thereof. Alternatively, it may comprise a combination of a member provided thereon with the upper rail surface 12*a* and that provided thereon with the lower rail surface 12*b*. The former is efficiently produced as compared with the latter.

Figure 6:
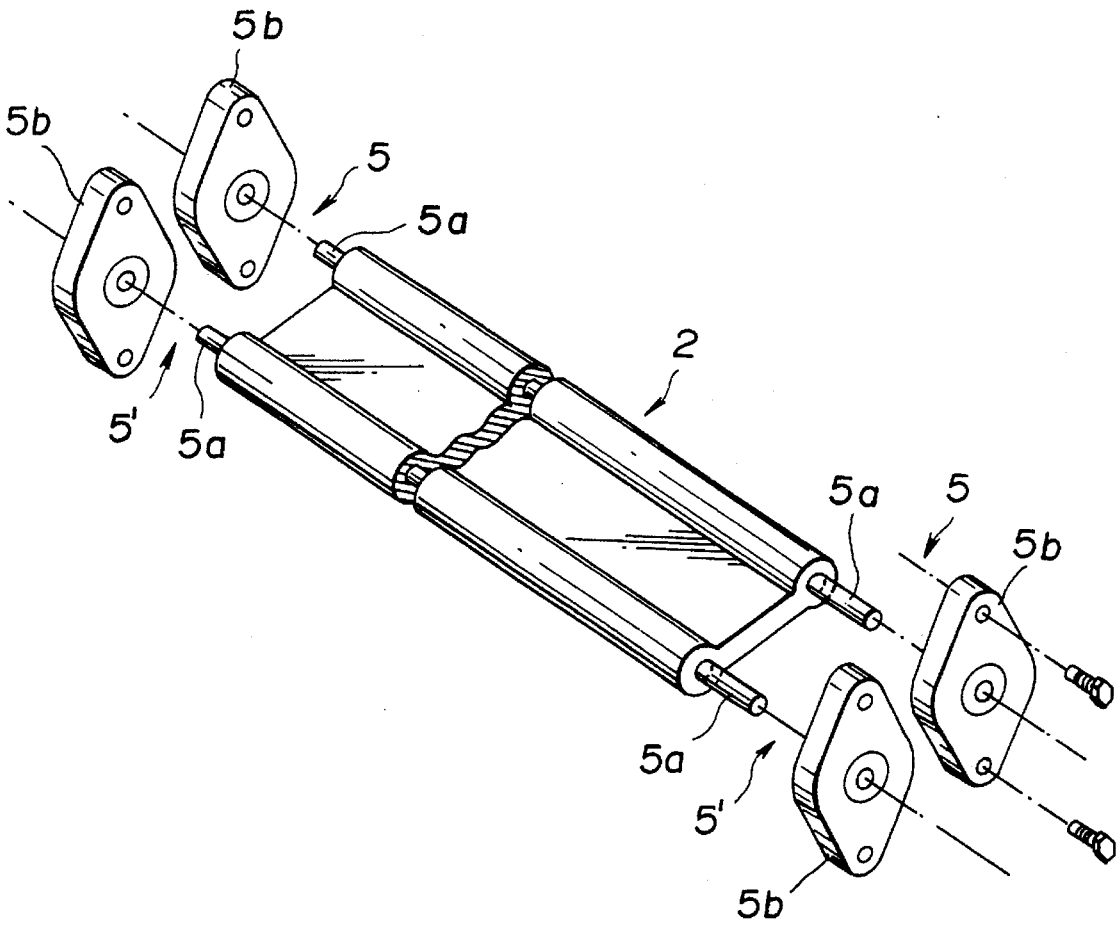
FIG. 6 is an exploded perspective view showing a link and turning pairs.

The link 2, as shown in FIG. 6, may be formed into a shape like an elongated plate of a reduced width, on both ends of which the turning pairs 5 and 5' each comprising shafts 5*a* and bearings 5*b* engaged with each other are arranged, respectively. Alternatively, the link 2 may be formed into any desired shape like a rod or the like so long as it permits the turning pairs 5 and 5' to be mounted thereon.

Figure 2:
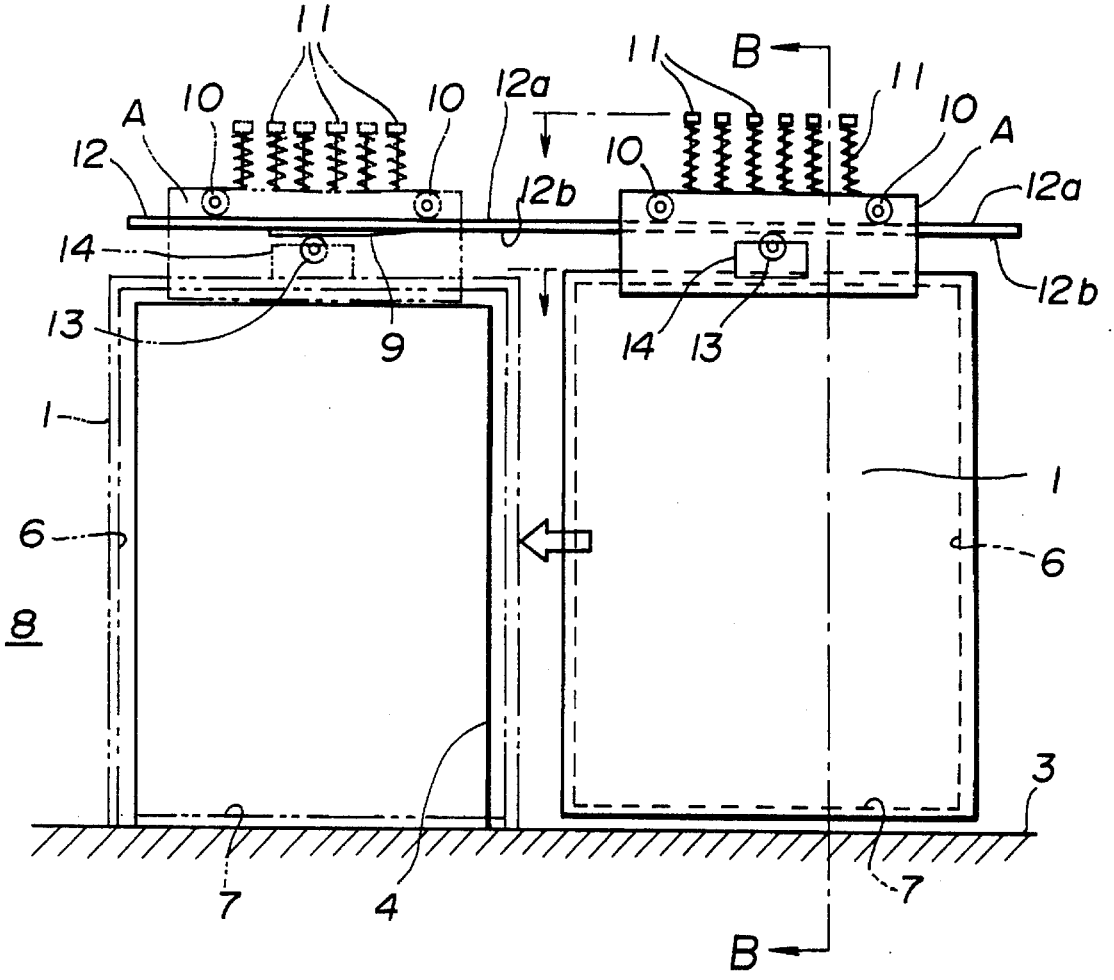
FIG. 2 is a front elevation view showing an embodiment of a sliding door according to the present invention, wherein the sliding door is moved to an entrance closed position at which the sliding door closes an entrance of an object.
Figure 3:
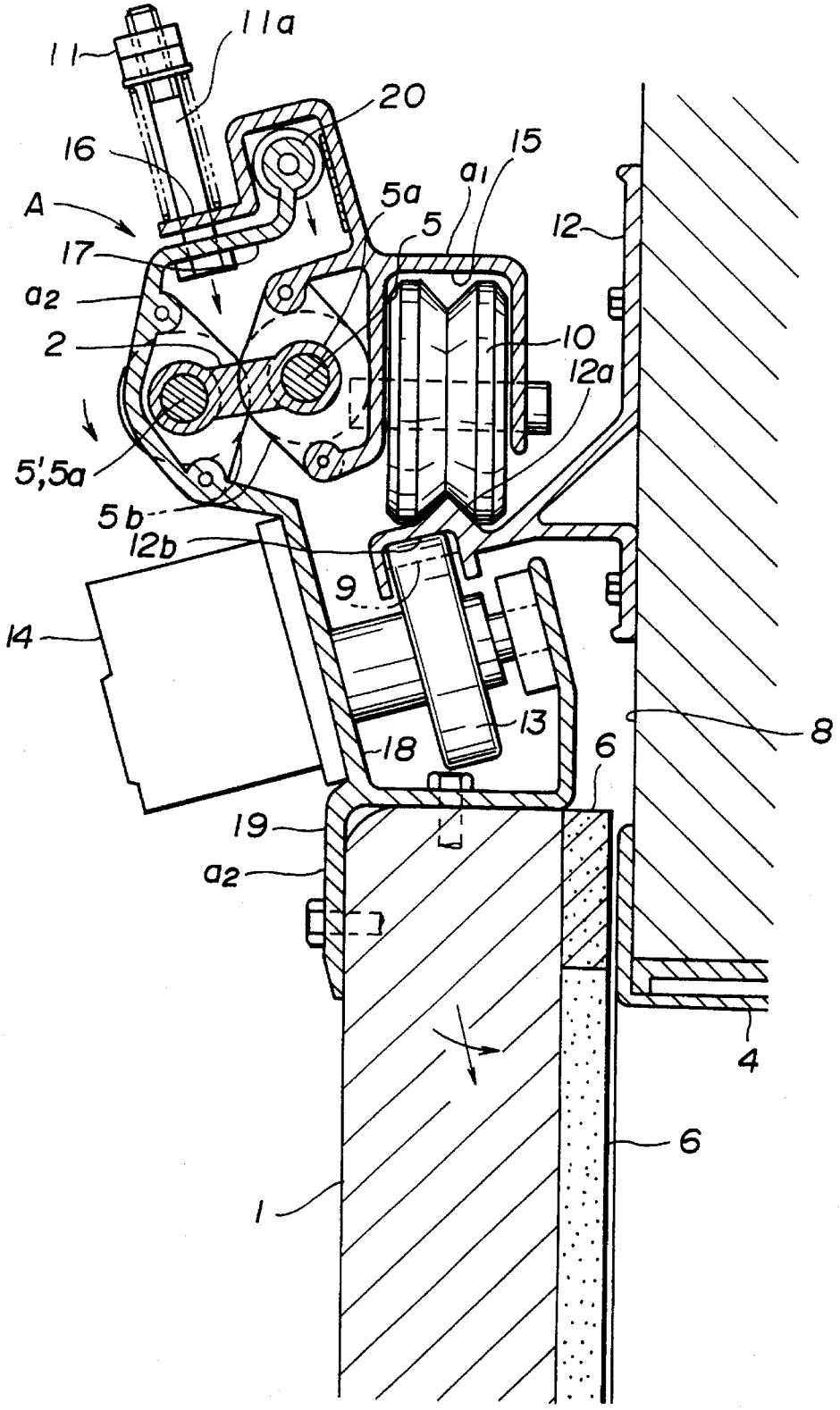
FIG. 3 is a fragmentary enlarged sectional view taken along line B—B of FIG. 2, wherein the sliding door is placed at an entrance opened position at which an entrance of an object is kept released from the sliding door.
Figure 4:
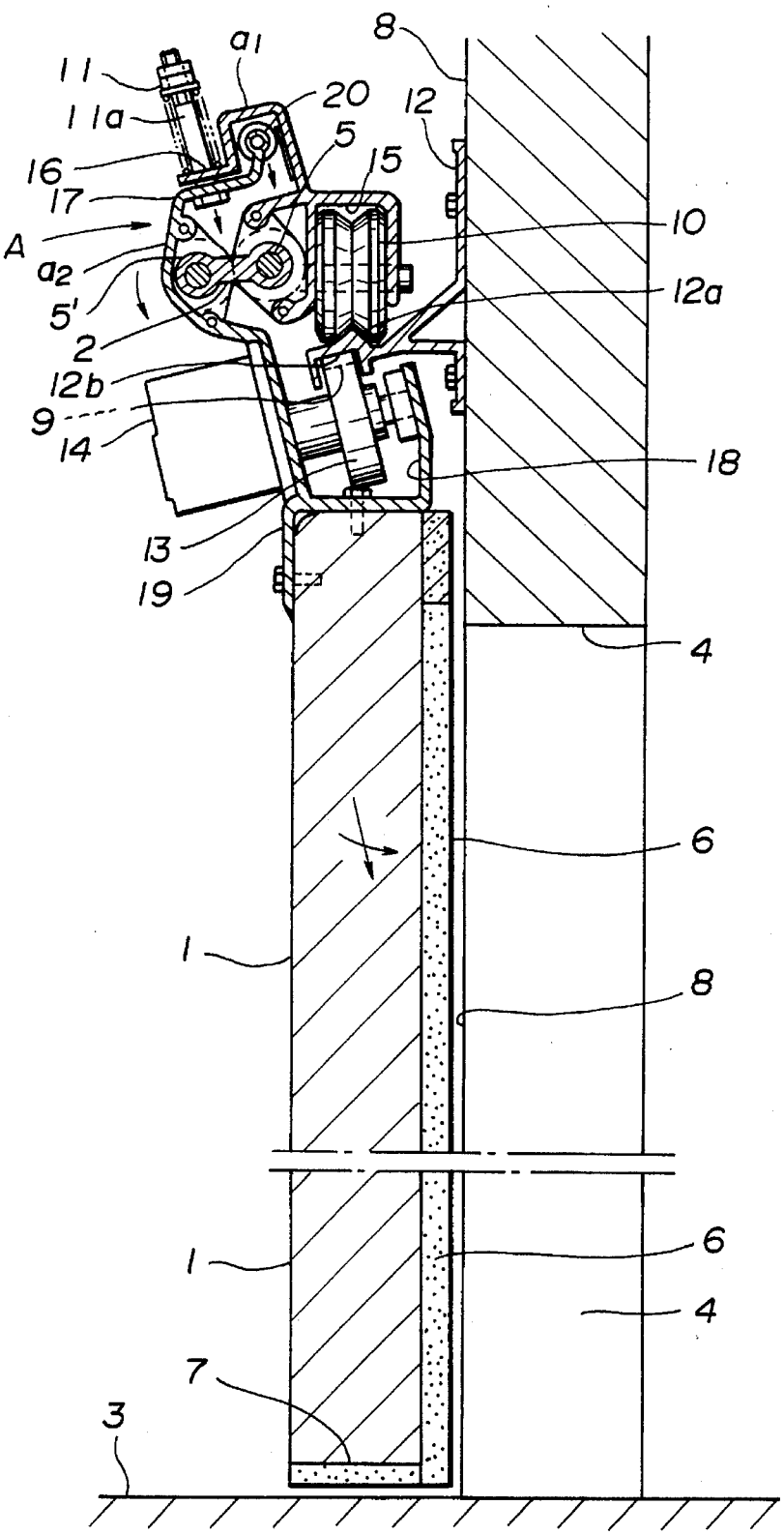
FIG. 4 is a sectional view taken along line B—B of FIG. 2, wherein the sliding door is placed at an entrance opened position.
Figure 5:
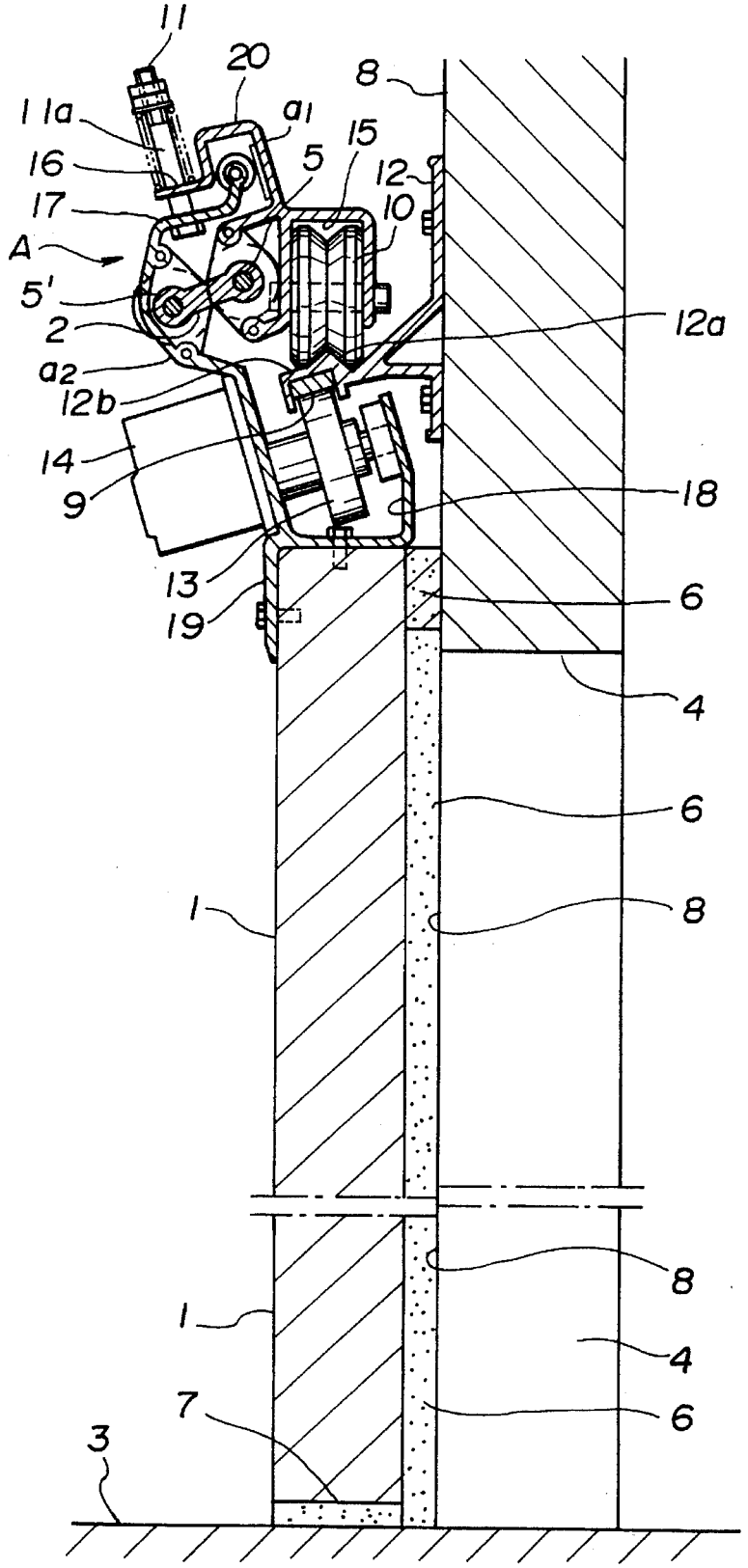
FIG. 5 is a sectional view taken along line B—B of FIG. 2, wherein the sliding door is placed at an entrance closed position.

The illustrated embodiment is constructed in the form of a single sliding door or so as to be slid in only one direction. In the illustrated embodiment, it is constructed so as to be moved in only a right direction for the door opening operation, as shown in FIG. 2. Alternatively, it may be constructed in the form of a double sliding door or slid. In this instance, two sliding doors which are constructed in substantially the same manner as described above are arranged in a manner to be symmetric with respect to the entrance 4 of the object.

Now, the manner of operation of the sliding door of the illustrated embodiment will be described hereinafter.

When the sliding door is placed at an entrance opened position at which the entrance 4 of the object is kept released from the door body 1, the door body 1 is kept raised from the floor of the object by upward elastic force of the elastic suspension 11 while being suspended from the upper rail surface 12*a* and pressedly contacting the driving wheel 13 with the lower rails surface 12*b* to control a distance between the door body 1 and the floor 3. Also, a bottom packing 7 is likewise kept raised from the floor 3. Thus, the door body 1 can be readily moved manually or through driving of the driving wheel 13 by means of the motor 14.

Then, the door body 1 is slidly moved to an entrance closed position at which the door body closes the entrance 4 of the object such as a refrigerator or the like. This causes the driving wheel 1 to strike on the tapered section 9 of the lower rail surface 12*b* of the rail 12, so that the door body 1 is downwardly moved against upward elastic force of the elastic suspension 11 while keeping the rolling wheels 10 carried on the upper rail surface 12*a* and the bracket a1 left at the original position.

More particularly, the door body 1 integrally associated with the bracket a2 is urged to be obliquely inwardly and downwardly forced by cooperation of the extensible rod 11*a* of each of the elastic suspensions 11 arranged on the first bracket a1 at a predetermined inclination angle and the lower rail surface 12*b* and driving wheel 13 inclined at the same angle. Concurrently, the second bracket a2 connected through the link 2 to the first bracket a1 causes the link 2 to be pivotally arcuately moved about the turning pair 5 on a side of the first bracket a1, so that the door body 1 may be quickly moved in an inward direction.

Figure 7:
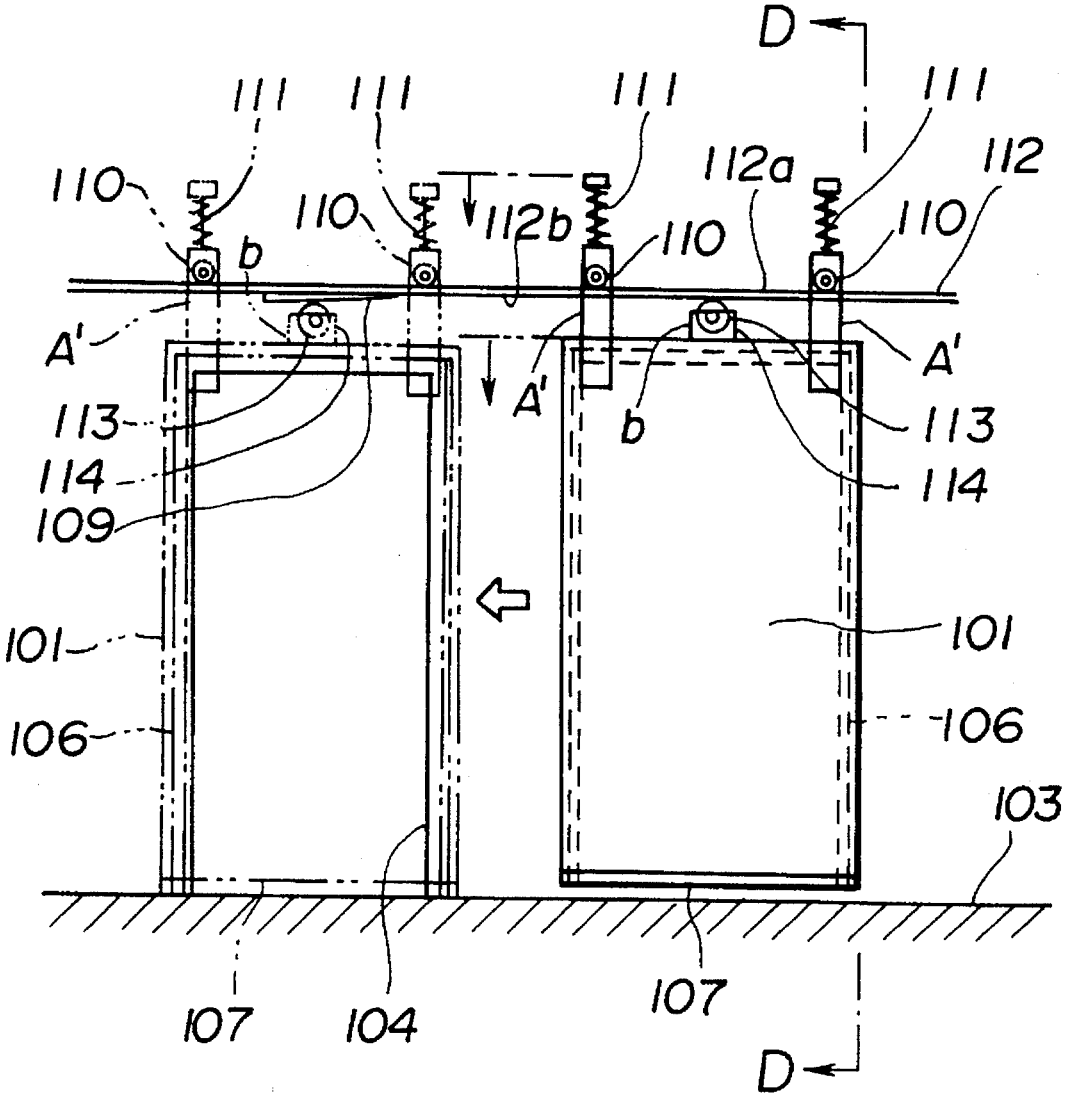
FIG.7 PRIOR ART
FIG. 7 is a front elevation view showing a conventional sliding door, wherein solid lines indicate the sliding door placed at an entrance opened position and phantom lines indicates it moved to an entrance closed position.
Figure 8:
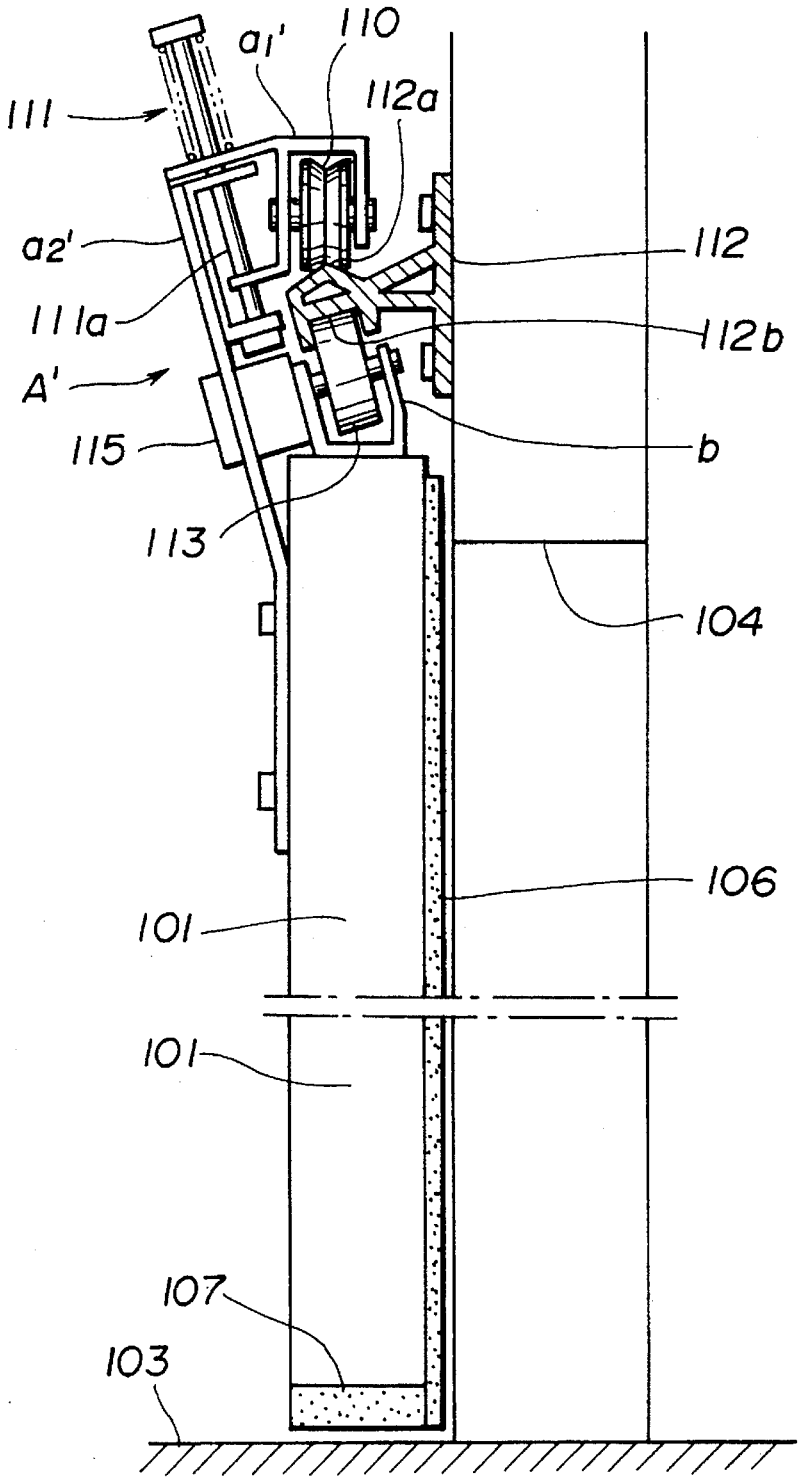
FIG.8 PRIOR ART
FIG. 8 is a sectional view taken along line line D—D of FIG. 7.

Thus, unlike the sliding door proposed by the inventor and described above with reference to FIGS. 7 and 8 wherein the door body 101 is gradually inwardly moved toward the outer wall surface of the refrigerator while being gradually lowered, the sliding door of the illustrated embodiment is so constructed that the door body 1 is not only gradually inwardly moved with respect to the outer wall surface of the object while being gradually lowered but quickly inwardly moved perpendicularly toward the outer wall surface due to pivotal movement of the link 2. This permits a peripheral packing 6 of the door body 1 to be closely contacted with a periphery of the entrance 4 of the object and the bottom packing 7 to be closely contacted with the floor 3, resulting in airtight closing of the entrance by the sliding door being carried out.

Subsequently, when the door body 1 thus placed at the entrance closed position is operated manually or through driving of the driving wheel 13 by the motor 14 for the purpose of opening the entrance 4, upward elastic force of each of the elastic suspensions 11 acts on the whole door body 1 to keep it suspended. Also, the driving wheel 13 striking on the tapered section 9 is gradually disengaged therefrom to cause the door body 1 to be gradually raised by upward elastic force of the elastic suspensions 11 and outwardly moved so as to separate from the outer wall surface 8 of the object. Concurrently, the link 2 causes the door body 1 to be quickly outwardly moved with respect to the outer wall surface 8. Thus, as soon as the driving wheel 13 starts to be moved on the tapered section 9, the peripheral packing 6 is released from the outer wall surface 8 and the bottom packing 7 is raised from the floor 3, so that the door body 1 may be readily moved for opening the entrance 4.

As can be seen from the foregoing, in the present invention, upward elastic force of the elastic suspensions causes the door body to be constantly upwardly forced, to thereby be kept raised form the floor. Thus, the door body may be smoothly and readily operated.

In the sliding door proposed by the invention and described above with reference to FIGS. 7 and 8, during the door closing operation, the door body is gradually downwardly inwardly moved to cause a packing on an inner surface of the door body to be gradually pressedly contacted with a wall surface of the object while being rubbed against the wall surface, resulting in highly increased frictional resistance being produced. This causes increased force to be required at the end of the door closing operation. Also, when the door opening operation is to be started, separation of the door body from the wall surface requires force sufficient to overcome the increased frictional resistance. This causes the door closing operation by hand to be highly troublesome and that by electric driving to require a motor of an increased capacity.

On the contrary, the sliding door of the present invention, as described above, is so constructed that during the door closing operation, not only the driving wheel strikes on the tapered section of the lower rail surface to permit the door body to be gradually downwardly inwardly moved against upward elastic force of the elastic suspensions as in the proposed sliding door, but the link concurrently functions to permit the door body to be quickly inwardly moved perpendicularly toward the outer wall surface of the object due to pivotal movement of the link 2. Thus, the door body can be quickly smoothly moved in a direction perpendicular to the object while being smoothly moved in an obliquely inward downward direction to the object. Thus, the sliding door of the present invention can smoothly and positively close the entrance of the object such as a refrigerator while significantly reducing pressed contact between the packing and the outer wall surface.

Also, when the door opening operation is to be carried out, the driving wheel is kept placed on the tapered section against upward elastic force of the elastic suspensions, to thereby increase the upward elastic force. Also, during the door opening operation, upward and outward movement of the door body is carried out concurrently with outward movement thereof in a direction perpendicular to the outer wall surface of the object by action of the link. Thus, the door opening operation can be smoothly and readily accomplished with reduced force by hand or by means of a motor of a reduced capacity driven at 100 V and 90 W.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A sliding door comprising:

a door body;

a bracket assembly including a first bracket and a second bracket;

said first bracket being provided at a lower portion thereof with a first groove which has rolling wheels rotatably supported therein and including a mounting seat section which has elastic suspensions mounted on an upper portion thereof while being slanted at a predetermined inclination angle;

said elastic suspensions each including an extensible rod;

said second bracket being formed at a lower portion thereof with a second groove which has a driving wheel rotatably supported therein while being slanted at the same inclination angle as that of said elastic suspensions and provided at an upper end thereof with a connection section to which said extensible rod of each of said elastic suspensions is connected at a distal end thereof so as to obliquely upwardly force said second bracket by upward elastic force of said elastic suspensions;

said second bracket being provided at a lower end thereof with a door mounting section through which said second bracket is mounted on said door body;

two turning pairs including a first turning pair arranged on an outside of said first groove of said first bracket and a second turning pair arranged on an inside of said second bracket opposite to said outside of said first groove;

said first and second turning pairs being connected to each other through a link, resulting in providing said bracket assembly;

said door body being mounted at an upper end thereof on said door mounting section of said second bracket, resulting in said bracket assembly being secured to said door body; and a rail including an upper rail surface on which said rolling wheels of said bracket assembly are carried and a lower rail surface slanted at the same inclination angle as that of said driving wheel and pressedly contacted with said driving wheel so as to downwardly force it;

said rail being horizontally rigidly arranged above an entrance of an object to be openably operated by said sliding door;

said door body being kept raised from a floor of said object by upward elastic force of said elastic suspensions while carrying said rolling wheels on said upper rail surface of said rail and said driving wheel being kept pressedly contacted with said lower rail surface of said rail by upward elastic force of said elastic suspensions;

said lower rail surface of said rail being formed on a portion thereof opposite to said driving wheel when said door body is moved to an entrance closed position with a tapered section on which said driving wheel strikes to obliquely move said door body in an inward and downward direction against upward elastic force of said elastic suspension.

2. A sliding door as defined in claim 1, wherein said door body is operated by hand.

3. A sliding door as defined in claim 1, wherein said elastic suspensions are selected from a group consisting of a spring, a hydraulic cylinder and an air cylinder.

4. A sliding door as defined in claim 1, wherein said tapered section is integrally formed on said lower rail surface.

5. A sliding door as defined in claim 1, wherein said tapered section comprises a tapered member arranged on said lower rail surface.

6. A sliding door as defined in claim 1, wherein said rail comprises a single member integrally provided on upper and lower portions thereof with said upper and lower rails surfaces.

7. A sliding door as defined in claim 1, wherein said rail comprises an upper rail section provided thereon with said upper rail surface and a lower rail section provided thereon with said lower rail surface.

8. A sliding door as defined in claim 1, wherein said door body is operated by means of a driving motor arranged on said second bracket for driving said driving wheel.

* * * * *